US009466898B2

(12) United States Patent
Ahn

(10) Patent No.: US 9,466,898 B2
(45) Date of Patent: Oct. 11, 2016

(54) CONNECTION TERMINAL

(71) Applicant: Samsung SDI Co., Ltd., Yongin-si, Gyeonggi-do (KR)

(72) Inventor: Sang-Kyu Ahn, Yongin-si (KR)

(73) Assignee: Samsung SDI Co., Ltd., Yongin-si (KR)

( * ) Notice: Subject to any disclaimer, the term of this patent is extended or adjusted under 35 U.S.C. 154(b) by 70 days.

(21) Appl. No.: 14/542,382

(22) Filed: Nov. 14, 2014

(65) Prior Publication Data

US 2015/0140875 A1 May 21, 2015

(30) Foreign Application Priority Data

Nov. 20, 2013 (KR) ..... 10-2013-0141750

(51) Int. Cl.
*H01R 11/12* (2006.01)
*H01R 4/30* (2006.01)
*H01R 13/58* (2006.01)

(52) U.S. Cl.
CPC ..... *H01R 11/12* (2013.01); *H01R 4/302* (2013.01); *H01R 13/58* (2013.01)

(58) Field of Classification Search
CPC ..... H01R 4/302; H01R 13/58; H01R 11/22
See application file for complete search history.

(56) References Cited

U.S. PATENT DOCUMENTS 1,142,479 A * 6/1915 Beck ..... H01R 11/22 439/860
3,210,719 A * 10/1965 Graeff ..... H01R 4/26 439/439
3,345,622 A * 10/1967 Matsushita ..... H01R 11/22 174/267
4,428,637 A * 1/1984 Worth ..... H01R 12/675 439/405
4,684,197 A * 8/1987 Reichardt ..... H01R 12/675 439/404
4,702,708 A * 10/1987 Reuss ..... H01C 10/34 156/292
4,810,215 A * 3/1989 Kaneko ..... H01R 12/716 29/842
5,124,880 A * 6/1992 Okamoto ..... H01R 13/7197 361/306.1
5,683,255 A * 11/1997 Menze ..... H01R 13/646 439/63
6,045,405 A * 4/2000 Geltsch ..... H01R 13/5845 439/607.01
7,294,020 B2 * 11/2007 Zhao ..... H01R 43/16 439/627
2011/0014822 A1 * 1/2011 Kato ..... H01R 9/032 439/733.1
2015/0140875 A1 * 5/2015 Ahn ..... H01R 11/12 439/883

FOREIGN PATENT DOCUMENTS

KR 1020020052531 7/2002
KR 20-2009-0006704 7/2009
KR 20-2009-0013249 12/2009

* cited by examiner

*Primary Examiner* — James Harvey
(74) *Attorney, Agent, or Firm* — Knobbe Martens Olson & Bear LLP

(57) ABSTRACT

Provided is a connection terminal including: a conductive plate including a connection unit having a ring shape, and an extension unit integrally formed with the connection unit and extending from one side of the connection unit; and a connection cable electrically connected to the conductive plate, wherein the conductive plate further includes a damping portion formed as a part of the extension unit and bent to protrude along a direction perpendicular to the connection unit.

16 Claims, 4 Drawing Sheets

CONNECTION TERMINAL

CROSS-REFERENCE TO RELATED APPLICATIONS

This application claims the benefit of Korean Patent Application No. 10-2013-0141750, filed on Nov. 20, 2013, in the Korean Intellectual Property Office, the disclosure of which is incorporated herein in its entirety by reference.

BACKGROUND

1. Field

One or more embodiments of the present invention relate to connection terminals.

2. Description of the Related Technology

A product that requires electrical connection, such as a battery pack, uses various members for the electrical connection. Connection members for the electrical connection may be connected to components forming the product via mechanicalcoupling, and the mechanical coupling should be stably maintained for stable electrical connection between the components.

SUMMARY OF CERTAIN INVENTIVE ASPECTS

One or more embodiments of the present invention include connection terminals.

Additional aspects will be set forth in part in the description which follows and, in part, will be apparent from the description, or may be learned by practice of the presented embodiments.

According to one or more embodiments of the present invention, a connection terminal includes: a conductive plate including a connection unit that extends in a first direction and an extension unit coupled to the connection unit and extending from one side of the connection unit; and a connection cable electrically connected to the conductive plate, wherein the conductive plate further includes a damping portion formed as a part of the extension unit and is bent to protrude along a second direction that intersects the first direction.

The damping portion may have at least four bent points.

The conductive plate may have a substantially uniform thickness.

The damping portion may have a substantially uniform width.

The damping portion may have a substantially uniform cross-sectional area.

The damping portion may include: a first portion extending along a direction substantially perpendicular to the first direction; a second portion disposed substantially parallel to the first portion; and a third portion connecting one end of the first portion and one end of the second portion, and bent with respect to the first and second portions.

The third portion may be bent in an arch shape.

An end portion of the connection cable may contact one side surface of the damping portion.

The connection cable may include a wire and a sheath layer for covering at least a part of the wire, and an end portion of the wire not covered by the sheath layer may contact the one side surface of the damping portion.

According to one or more embodiments of the present invention, a connection terminal includes: and end portion and a conductive plate including a connection unit that is disposed on a first plane and has a hole at a center and a connection cable electrically connected to the conductive plate, wherein the end portion of the conductive plate extends from one side of the connection unit and is bent to form a damping portion protruding along a direction that intersects the first plane.

The damping portion may include: a first portion extending along a direction substantially perpendicular to the first plane; a second portion disposed substantially parallel to the first portion; and a third portion connecting one end of the first portion and one end of the second portion, and bent with respect to the first and second portions.

Another end of the first portion may be connected to the connection unit and another end of the second portion may be adjacently disposed to the connection cable.

The third portion may be bent in an arch shape.

The damping portion may have a substantially uniform width.

The damping portion may have a substantially uniform thickness.

The damping portion may have a substantially uniform cross-sectional area.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION OF CERTAIN INVENTIVE EMBODIMENTS

Figure 1:
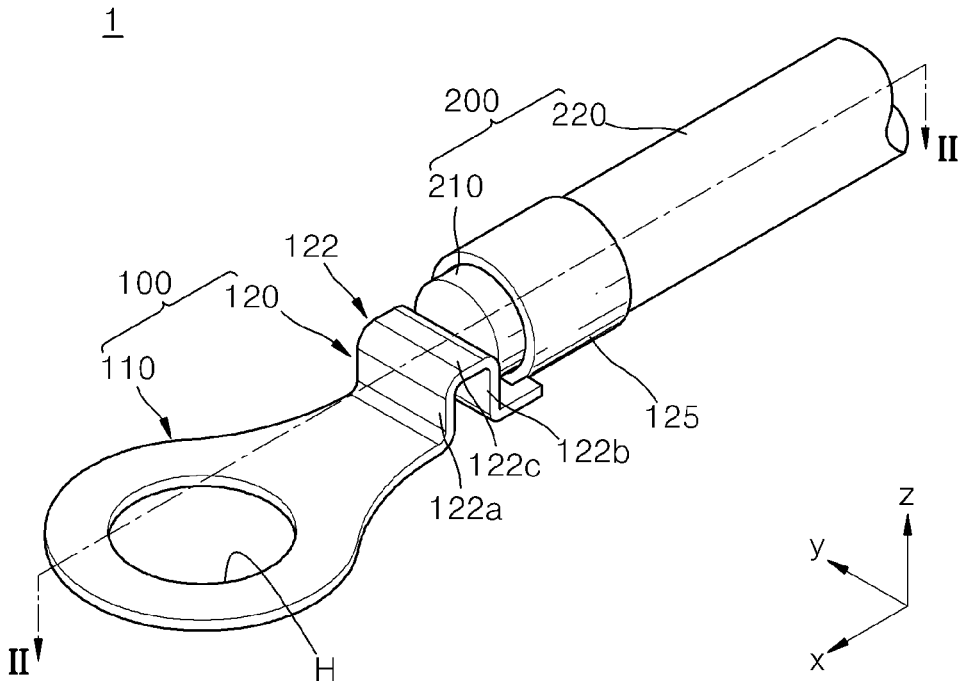
FIG. 1 is a perspective view of a connection terminal according to an embodiment of the present invention.

Reference will now be made in detail to embodiments, examples of which are illustrated in the accompanying drawings. In this regard, the present embodiments may have different forms and should not be construed as being limited to the descriptions set forth herein. Accordingly, the embodiments are merely described below, by referring to the figures, to explain aspects of the present description.

In drawings, like reference numerals refer to like elements throughout and overlapping descriptions shall not be repeated.

While such terms as "first," "second," etc., may be used to describe various components, such components must not be limited to the above terms. The above terms are used only to distinguish one component from another.

An expression used in the singular encompasses the expression of the plural, unless it has a clearly different meaning in the context.

In the present specification, it is to be understood that the terms such as "including" or "having," etc., are intended to indicate the existence of the features or components, and are not intended to preclude the possibility that one or more other features or components may exist or may be added.

It will be understood that when a component or layer is referred to as being "on" another component or layer, the component or layer can be directly on another component or layer or intervening component or layers.

In drawings, for convenience of description, sizes of components may be exaggerated for clarity. For example, since sizes and thicknesses of components in drawings are arbitrarily shown for convenience of description, the sizes and thicknesses are not limited thereto.

As used herein, the term "and/or" includes any and all combinations of one or more of the associated listed items.

Figure 2:
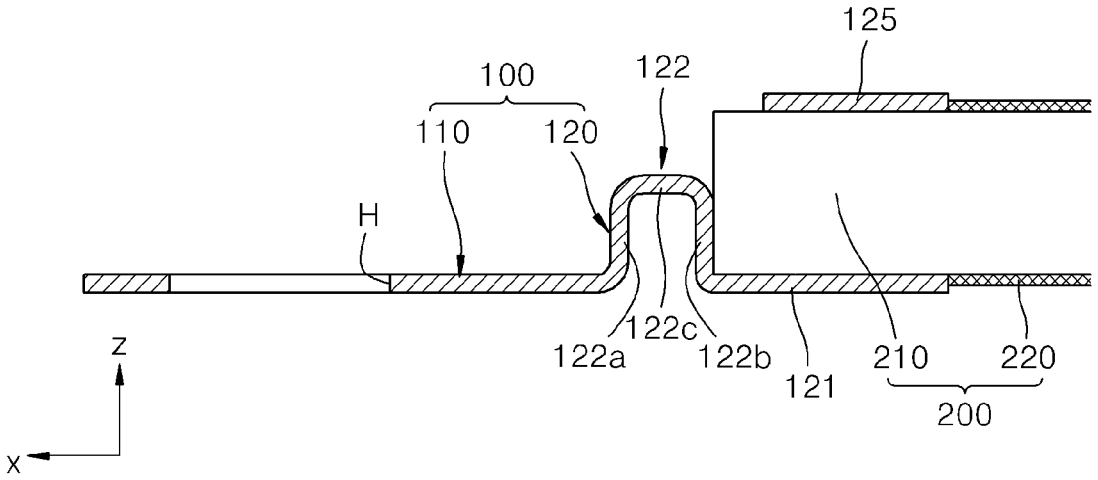
FIG. 2 is a cross-sectional view taken along a line II-II of FIG. 1.

FIG. 1 is a perspective view of a connection terminal 1 according to an embodiment of the present invention, and FIG. 2 is a cross-sectional view taken along a line II-II of FIG. 1.

Referring to FIGS. 1 and 2, the connection terminal 1 includes a conductive plate 100 and a connection cable 200, and the conductive plate 100 includes a damping portion 122.

The conductive plate 100 may include a connection unit 110 and an extension unit 120. The connection unit 110 is a region connected via a coupling member, such as a bolt or a screw, and may have a ring shape having a hole at a center such that the coupling member is inserted thereto. The connection unit 110 may be disposed on a first plane, for example, an x-y plane of FIG. 1.

The extension unit 120 may extend from one side of the connection unit 110, and may be integrally formed with the connection unit 110. The extension unit 120 includes the damping portion 122.

The damping portion 122 may be formed by bending an end portion of the conductive plate 100 having a uniform thickness. For example, the damping portion 122 may be formed by bending at least a part of the extension unit 120. The damping portion 122 may be formed by bending a part of the extension unit 120 at least four times for example. The damping portion 122 may protrude in a direction perpendicular to the first plane, for example, upward (z-direction) as shown in FIG. 1.

The damping portion 122 may include a first portion 122*a* extending in a direction substantially perpendicular to the first plane, a second portion 122*b* substantially parallel to the first portion 122*a*, and a third portion 122*c* connecting the first and second portions 122*a* and 122*b*. The third portion 122*c* may be bent substantially perpendicular to the first and second portions 122*a* and 122*b*.

The connection cable 200 may include a wire 210 formed of a conductive metal, such as copper, and a sheath layer 220 covering an outer surface of the wire 210. At one end of the connection cable 200, the wire 210 may be exposed without being surrounded by the sheath layer 220.

The connection cable 200 may be electrically connected to the conductive plate 100. The wire 210 at one end of the connection cable 200 may contact the conductive plate 100 to be electrically connected to the conductive plate 100.

For example, the wire 210 at one end of the conductive plate 100 may be inserted and combined to an end portion of an extension member, for example, a fixing portion formed at one end portion of the extension unit 120 located farther from the connection unit 110. The wire 210 inserted to a fixing portion 125 may be electrically connected to the conductive plate 100 by directly contacting a bottom surface 121 of the extension unit 120 and one side surface (for example, one side surface of the second portion 122*b*) of the damping portion 122.

The connection terminal 1, according to an embodiment, may be used to electrically connect two components (not shown). For example, when the connection terminal 1 is used in a battery pack, one side of the connection terminal 1 may be connected to a first component (not shown), such as a battery, and the other side of the connection terminal 1 may be connected to a second component (not shown), such as a protection circuit module, thereby electrically connecting the first and second components.

When external vibration is applied to the connection terminal 1 electrically connecting the first and second components but there is no damping portion 122, the external vibration is intactly transferred to the connection terminal 1, and thus the connection terminal 1 and the first component (or the second component) may be disconnected.

However, according to an embodiment of the present invention, the damping portion 122 of the connection terminal 1 absorbs the external vibration, and thus the connection terminal 1 and the first component (or the second component) is prevented or at least inhibited from being disconnected.

In this regard, vibration absorption of the damping portion 122 will now be described in detail with reference to FIGS. 3A and 3B.

Figure 3A:
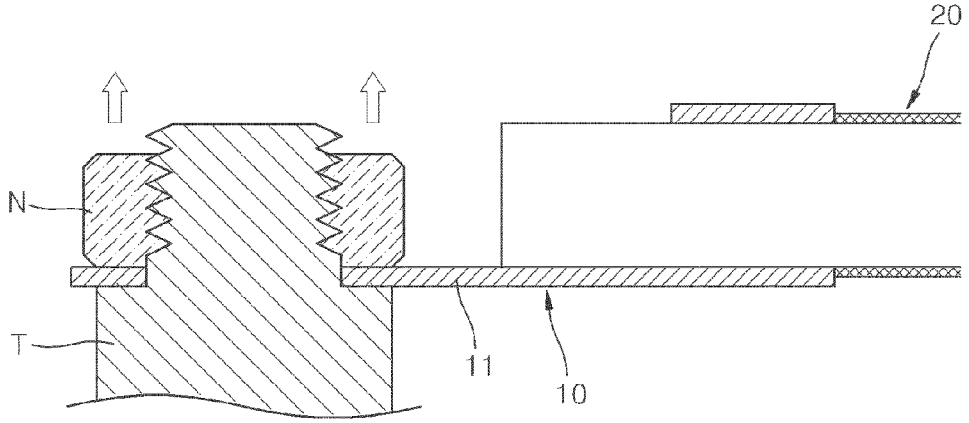
FIG. 3A (prior art)
FIG. 3A is a mimetic diagram for describing a change according to vibration of a connection terminal according to a comparative example.
Figure 3B:
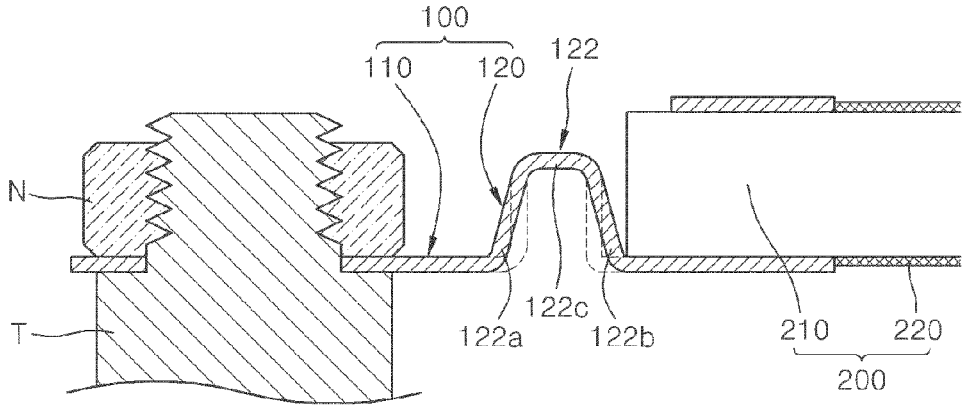
FIG. 3B is a mimetic diagram for describing a change according to vibration of a connection terminal according to an embodiment of the present invention.

FIG. 3A is a mimetic diagram for describing a change according to vibration of a connection terminal according to a comparative example, and FIG. 3B is a mimetic diagram for describing a change according to vibration of the connection terminal 1 according to an embodiment of the present invention.

Referring to FIG. 3A, the connection terminal according to the comparative example does not include a damping portion. A connection unit of the connection terminal is combined to a bolt type positive electrode terminal T (or a negative electrode terminal) of a battery via a nut N, and a connection cable 20 may be connected to a component of a battery pack, such as a protection circuit module (not shown).

When vibration is applied to the battery pack including the connection terminal according to the comparative example, the vibration may be intactly transferred to a conductive plate 10 of the connection terminal. For example, the vibration may be intactly transferred to a connection unit 11 of the connection terminal. Since the vibration is transferred, the nut N is loosened, and thus the positive electrode terminal T (or the negative electrode terminal) and the conductive plate 10 may be disconnected.

However, according to an embodiment of the present invention, since the conductive plate 100 includes the damping portion 122, external vibration applied to the conductive plate 100 is absorbed by the damping portion 122, and thus the positive electrode terminal T (or the negative electrode terminal) and the conductive plate 100 are less likely to be disconnected.

Referring to FIG. 3B, when vibration is applied to the battery pack including the connection terminal 1, the vibration is transferred to the damping portion 122 of the connection terminal 1. The vibration changes a shape of the damping portion 122 and is less likely to reach the connection unit 110. In other words, since the damping portion 122 absorbs the vibration, the positive electrode terminal T (the negative electrode terminal) and the connection unit 110 may be connected to each other.

Figure 4:
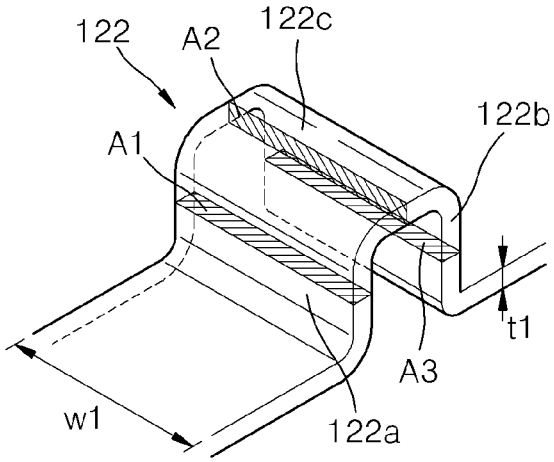
FIG. 4 is a perspective view of a damping portion of the connection terminal of FIG. 1, according to an embodiment of the present invention.

FIG. 4 is a perspective view of the damping portion 122 of the connection terminal 1 of FIG. 1, according to an embodiment of the present invention.

Referring to FIG. 4, the damping portion 122 may have a substantially uniform width w1 and/or a substantially uniform thickness t1. The damping portion 122 may have a substantially uniform cross-sectional area. For example, a cross-sectional area A1 of the first portion 122*a*, a cross-sectional area A2 of the second portion 122*b*, and a cross-sectional area A3 of the third portion 122*c* may have a substantially uniform value.

The damping portion 122 disposed between the connection unit 110 and the connection cable 200 provides a path of a current. According to this embodiment, if the width w1, the thickness t1, or the cross-sectional area of the damping portion 122 is not uniform, resistance of the damping portion 122 changes, and thus a flow of current passing through the damping portion 122 may be disturbed.

However, since the damping portion 122 has the uniform width w1 and the uniform cross-sectional area, the damping portion 122 may absorb vibration while not affecting the flow of current passing therethrough.

Figure 5:
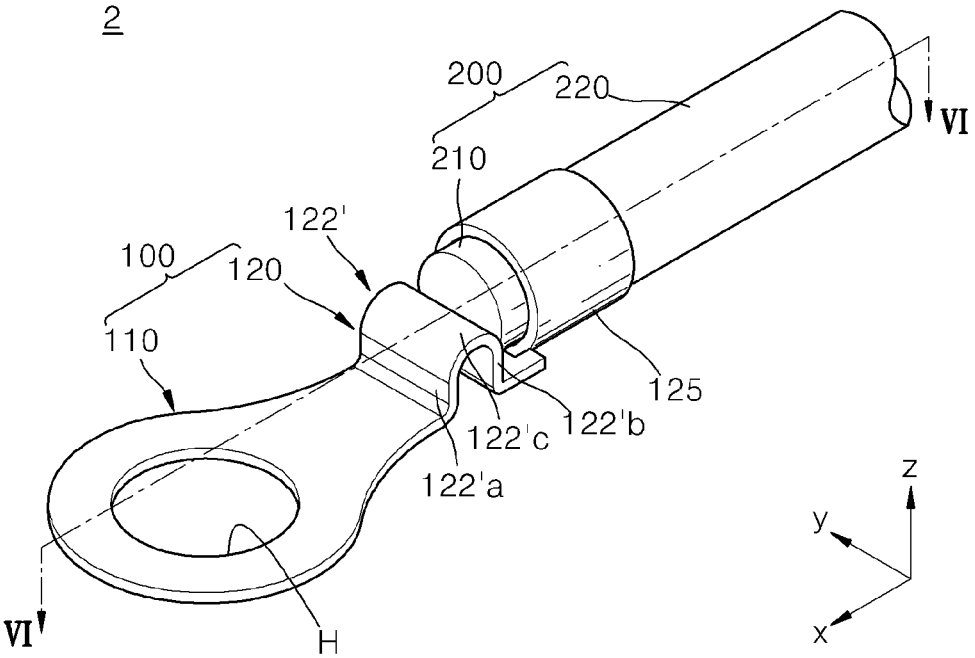
FIG. 5 is a perspective view of a connection terminal according to another embodiment of the present invention.
Figure 6:
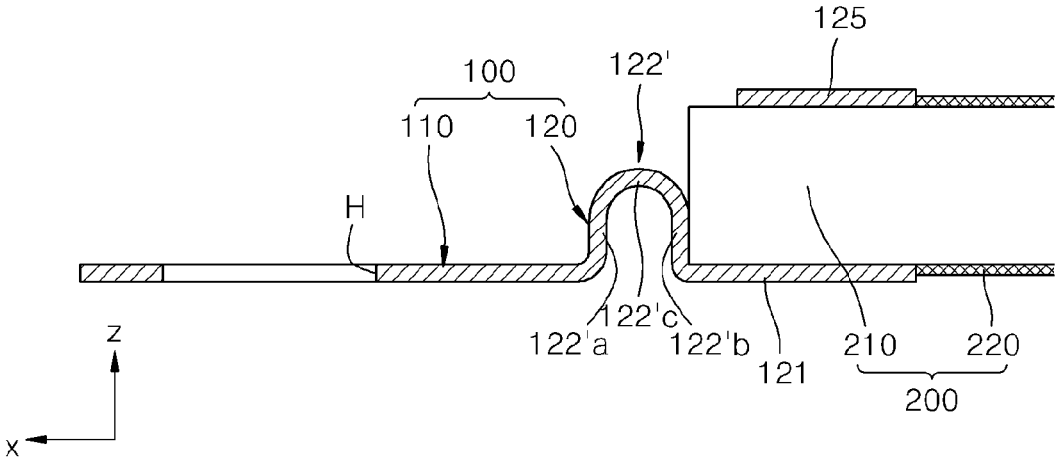
FIG. 6 is a cross-sectional view taken along a line VI-VI of FIG. 5.

FIG. 5 is a perspective view of a connection terminal 2 according to another embodiment of the present invention, and FIG. 6 is a cross-sectional view taken along a line VI-VI of FIG. 5.

Referring to FIGS. 5 and 6, the connection terminal 2 according to the current embodiment includes the conductive plate 100 and the connection cable 200 like the connection terminal 1 described above with reference to FIGS. 1 through 4, and the conductive plate 100 includes the connection unit 110 and the extension unit 120 including a damping portion 122'.

The connection cable 200 may include the wire 210 formed of a conductive metal, such as copper, and the sheath layer 220 covering the outer surface of the wire 210. At one end of the connection cable 200, the wire 210 may be exposed without being surrounded by the sheath layer 220. The wire 210 at one end of the connection cable 200 contacts the conductive plate 100 to be electrically connected to the conductive plate 100.

Since the structure and functions of the connection terminal 2 according to the current embodiment are substantially the same as those of the connection terminal 1 described above with reference to FIGS. 1 through 4, differences therebetween will be mainly described.

The damping portion 122' of the connection terminal 2 may be bent at least four times. Here, an upper surface of the damping portion 122' may be bent in a curved surface such that the damping portion 122 is in an arch shape.

For example, the damping portion 122' may include a first portion 122'*a* extending in a direction substantially perpendicular to the first plane, a second portion 122'*b* substantially parallel to the first portion 122'*a*, and a third portion 122'*c* having a curved surface and connecting the first and second portions 122'*a* and 122'*b*. The third portion 122'*c* of the damping portion 122' may be bent with respect to the first and second portions 122'*a* and 122'*b* smoothly to form a curved surface in overall.

As described above with reference to FIGS. 3A and 3B, the damping portion 122' may absorb vibration. When the damping portion 122' is bent in the arch shape as in the current embodiment, the damping portion 122' efficiently absorbs vibration, and thus the damping portion 122' is prevented from breaking or being damaged.

As described above, according to the one or more of the above embodiments of the present invention, there is provided a connection terminal capable of preventing a coupling member, such as a screw or a bolt, from being loosened due to external vibration.

According to the one or more embodiments of the present invention, a flow of current transferred through the connection terminal may be uniformly maintained.

While one or more embodiments of the present invention have been described with reference to the figures, it will be understood by those of ordinary skill in the art that various changes in form and details may be made therein without departing from the spirit and scope of the present invention as defined by the following claims.

What is claimed is:

1. A connection terminal comprising:

a conductive plate comprising a connection unit that extends in a first direction and an extension unit coupled to the connection unit and extending from one side of the connection unit in the first direction; and a connection cable electrically connected to the conductive plate, wherein the conductive plate further comprises a damping portion formed as a part of the extension unit and bent to protrude along a second direction that intersects the first direction so as to damp forces propagating in the first direction;

wherein the damping portion comprises:

a first portion extending along a direction substantially perpendicular to the first direction;

a second portion disposed substantially parallel to the first portion; and a third portion connecting one end of the first portion and one end of the second portion, and bent with respect to the first and second portions.

2. The connection terminal of claim 1, wherein the damping portion has at least four bent points.

3. The connection terminal of claim 1, wherein the conductive plate has a substantially uniform thickness.

4. The connection terminal of claim 1, wherein the damping portion has a substantially uniform width.

5. The connection terminal of claim 4, wherein the damping portion has a substantially uniform cross-sectional area.

6. A connection terminal comprising:

a conductive plate comprising an extension unit and a connection unit that is disposed on a first plane and has a hole at a center; and a connection cable electrically connected to the conductive plate, wherein the extension unit of the conductive plate extends from one side of the connection unit in a first direction and is bent to form a damping portion protruding along a second direction that intersects the first plane;

wherein the damping portion comprises:

a first portion extending along a direction substantially perpendicular to the first direction;

a second portion disposed substantially parallel to the first portion; and a third portion connecting one end of the first portion and one end of the second portion, and bent with respect to the first and second portions.

7. The connection terminal of claim 1, wherein the third portion is bent in an arch shape.

8. The connection terminal of claim 1, wherein an end portion of the connection cable contacts one side surface of the damping portion.

9. The connection terminal of claim 8, wherein the connection cable comprises a wire and a sheath layer for covering at least a part of the wire, and an end portion of the wire not covered by the sheath layer contacts the one side surface of the damping portion.

10. The connection terminal of claim 1, wherein the connection unit has a ring shape and the extension unit is integrally formed with the connection unit.

11. The connection terminal of claim 6, wherein the damping portion has a substantially uniform cross-sectional area.

12. A connection terminal comprising:

a conductive plate comprising an extension unit and a connection unit that is disposed on a first plane and has a hole at a center; and a connection cable electrically connected to the conductive plate, wherein the extension unit of the conductive plate extends from one side of the connection unit and is bent to form a damping portion protruding along a direction that intersects the first plane;

wherein the damping portion comprises:

a first portion extending along a direction substantially perpendicular to the first plane;

a second portion disposed substantially parallel to the first portion; and a third portion connecting one end of the first portion and one end of the second portion, and bent with respect to the first and second portions.

13. The connection terminal of claim 12, wherein another end of the first portion is connected to the connection unit and another end of the second portion is adjacently disposed to the connection cable.

14. The connection terminal of claim 12, wherein the third portion is bent in an arch shape.

15. The connection terminal of claim 6, wherein the damping portion has a substantially uniform width.

16. The connection terminal of claim 6, wherein the damping portion has a substantially uniform thickness.

* * * * *